US008333071B2

(12) United States Patent
Oakley et al.

(10) Patent No.: US 8,333,071 B2
(45) Date of Patent: Dec. 18, 2012

(54) METHOD AND A SYSTEM TO CONTROL TURBINE INLET TEMPERATURE

(75) Inventors: Aaron John Oakley, Chelmsford (GB); Paul Martin Niessen, Plymouth, MI (US); Jason Ronald Smith, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 810 days.

(21) Appl. No.: 12/533,455

(22) Filed: Jul. 31, 2009

(65) Prior Publication Data

US 2011/0023478 A1 Feb. 3, 2011

(51) Int. Cl.
*F02B 29/00* (2006.01)
*F02B 33/44* (2006.01)
*F02D 23/00* (2006.01)

(52) U.S. Cl. ..... 60/599; 60/600; 60/601; 60/605.2

(58) Field of Classification Search ..... 60/599, 60/600, 601, 605.2, 608
See application file for complete search history.

(56) References Cited

U.S. PATENT DOCUMENTS

| | | | | |
|---|---|---|---|---|
| 6,829,890 | B2 | 12/2004 | Gui et al. | |
| 6,978,604 | B2 | 12/2005 | Wang et al. | |
| 2004/0123741 | A1 * | 7/2004 | Ohtake et al. | 96/420 |
| 2006/0042258 | A1 * | 3/2006 | Gadde et al. | 60/772 |
| 2006/0242950 | A1 * | 11/2006 | Wang et al. | 60/295 |
| 2010/0307137 | A1 * | 12/2010 | Barrillon et al. | 60/285 |

* cited by examiner

*Primary Examiner* — Mary A Davis
(74) *Attorney, Agent, or Firm* — Julia Voutyras; Brooks Kushman P.C.

(57) ABSTRACT

A method and system to control an engine to maintain turbine inlet temperature utilizes two temperature thresholds: a control initiation temperature and a maximum hardware temperature. An engine parameter is adjusted in a closed-loop manner based on an error, which is a difference between a setpoint temperature and the turbine inlet temperature. The setpoint temperature is initially the control initiation temperature. However, after control over turbine inlet temperature is established, the setpoint temperature ramps gradually to maximum hardware temperature. In one embodiment, the engine parameter is engine torque. Other engine parameters affecting turbine inlet temperature include timing and duration of fuel injection pulses, EGR rate, gear selection, and intake throttle position, any of which can be used in place of, or in combination with, torque for controlling turbine inlet temperature.

20 Claims, 5 Drawing Sheets

METHOD AND A SYSTEM TO CONTROL TURBINE INLET TEMPERATURE

BACKGROUND

1. Technical Field

The present development relates to controlling inlet temperature of gases supplied to an exhaust turbine such that the inlet temperature is below a temperature at which the turbine is damaged.

2. Background Art

The exhaust from a turbocharged engine is supplied to the turbine portion of the turbocharger. When the temperature of the exhaust gases at the turbine inlet exceeds a hardware limit temperature of the turbine, measures are taken to reduce turbine inlet temperature. It is known in the prior art to reduce the amount of torque produced by the engine by a predetermined amount from the operator demanded torque so that the exhaust temperature drops below the hardware limit temperature. However, the problems with this approach include: dropping torque in a stepwise manner is noticeable and disconcerting to the vehicle operator; and reducing torque in an open-loop manner leads to overcompensation (too much torque drop) at some operation conditions and undercompensation (failing to protect turbine) at other operating conditions. To avoid undercompensation, the amount of torque reduction is selected to provide an adequate safety factor for the most demanding condition, which is excessive for most operating conditions.

In other strategies, the engine is controlled closed-loop based on an error between a control temperature and the turbine inlet temperature. However, because of thermal inertia in the system, turbine inlet temperature overshoots the control temperature markedly even when a mitigating measure is initiated. If the control temperature is set equal to the maximum hardware temperature, a significant risk of damage to the turbine is incurred during the period of overshoot. If, alternatively, the control temperature is a temperature below the maximum hardware temperature to provide a margin of safety for the turbine, then the steady state temperature achieved is lower than need be and thus, the amount of mitigation (torque reduction or adjustment of another engine parameter) is greater than necessary.

SUMMARY

According to an embodiment of the present disclosure, a method and system to control an internal combustion engine having an exhaust turbine involves determining a turbine inlet temperature, entering a torque reduction mode when the turbine inlet temperature exceeds a setpoint temperature, commanding the engine to provide a torque less than an operator demanded torque based on an error, and increasing the setpoint temperature gradually to a maximum hardware temperature during the torque reduction mode. The error is based on the turbine inlet temperature minus the setpoint temperature. The setpoint temperature is equal to a control initiation temperature upon entering the torque reduction mode and the control initiation temperature is less than the maximum hardware temperature by 20 to 80 degrees C. Upon obtaining control over turbine inlet temperature, the setpoint temperature is ramped up to the maximum hardware temperature.

Advantages of a sliding setpoint temperature include: torque reduction occurs smoothly, thus less disruptive to the vehicle operator, turbine inlet temperature is prevented from overshooting maximum hardware temperature, and the steady-state turbine inlet temperature reached maximum hardware temperature, thus, torque reduction is at a minimum when steady-state is reached.

Alternatively, other engine parameters can be adjusted to control turbine inlet temperature, either singly or in combination, with torque and/or other engine parameters. In such case, the mode is called a temperature control mode. The engine parameters include EGR (exhaust gas recirculation) rate as determined by EGR valve position, timing and pulse width of injection events, gear selection, and throttle valve position.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to configuration of an aftertreatment and EGR system for a turbocharged, diesel engine. The present development applies also to gasoline engines and other combustion systems having turbines. Those of ordinary skill in the art may recognize similar applications or implementations consistent with the present disclosure, e.g., ones in which components are arranged in a slightly different order than shown in the embodiments in the Figures. Those of ordinary skill in the art will recognize that the teachings of the present disclosure may be applied to other applications or implementations.

Figure 1:
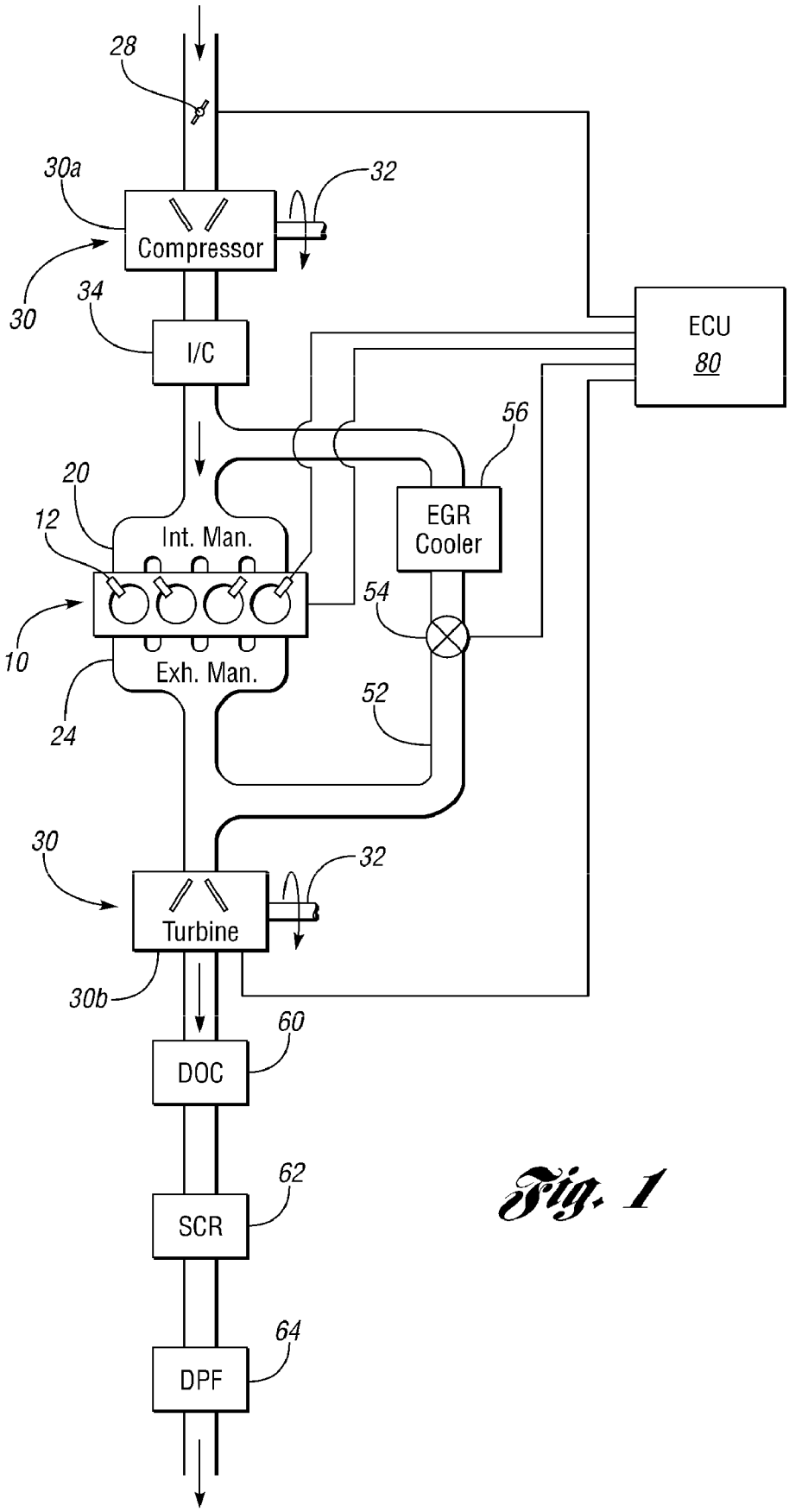
FIG. 1 is a schematic representation of an internal combustion engine with ancillary components.

Referring to FIG. 1, an engine 10 has fuel injectors 12 coupled to engine cylinders. Engine 10 is supplied air through intake manifold 20 and exhausts combustion products into an exhaust manifold 24. The intake system of engine 10 has a throttle valve 28 and a compressor section 30*a* of a turbocharger 30. Downstream of compressor 30*a* is an intercooler 34. In the engine exhaust is the turbine section 30*b* of turbocharger 30. The compressor 30*a* and turbine 30*b* are coupled via shaft 32 such that work extracted by turbine 30*b* drives compressor 30*a*. Compressor 30*a* and turbine 30*b* are housed in a single unit, but shown separated for schematic convenience. Upstream of turbine 30*b* is an EGR duct 52, which couples the engine exhaust with the engine intake allowing flow of exhaust gases to mix with incoming air into the engine 10. Disposed in EGR duct 52 are EGR valve 54 to control the amount of EGR flow and EGR cooler 56. Downstream of turbine 30*b* are aftertreatment components: diesel oxidation catalyst 60, selective catalyst reduction catalyst 62, and diesel particulate filter (DPF) 64. Alternatively, a plurality of any of the devices can be used and they can be placed in a different order than shown in FIG. 1. Engine 10 is shown as an in-line 4-cylinder engine. However, the present disclosure applies to all engine configurations of any number of cylinders.

Figure 2:
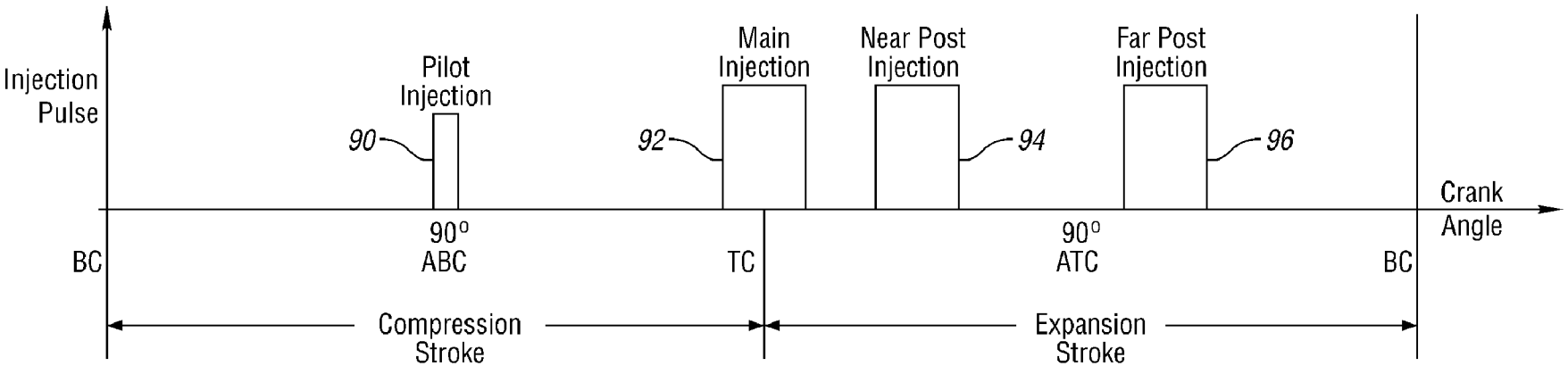
FIG. 2 shows a representative injection timing sequence.

Fuel injectors 12, EGR valve 54, turbine 30*b* (when a variable geometry turbine), and throttle valve 28 are electronically coupled to and controlled by electronic control unit (ECU) 80. The number, duration, and timing of fuel injection pulses are under control of the electronic control unit. An example injection timing diagram is shown in FIG. 2. A pilot injection 90 is commanded during a compression stroke. A main injection 92 is initiated just before top center (TC) between the compression and expansion strokes. A near post injection 94 is initiated in the range of 20 to 40 degrees after TC. A far post injection 96 is also shown in FIG. 2. It is initiated later in the expansion stroke, e.g., starting after 90 degrees after TC. The example shown in FIG. 2 has the duration of the post injections 94 and 96 about the same as main injection 92. Both the start of injection (initiation) and the pulse width (duration) of the injection events are under control ECU 80. The injection events illustrated in FIG. 2 are for a situation in which an increase in exhaust temperature is desired, for example, when the temperature of DPF 64 is to be raised to initiate a regeneration event, i.e., raise DPF 64 above the ignition temperature of the carbonaceous particulate matter collected therein. The use of and the duration of post injections impacts the temperature in the exhaust.

Figure 3:
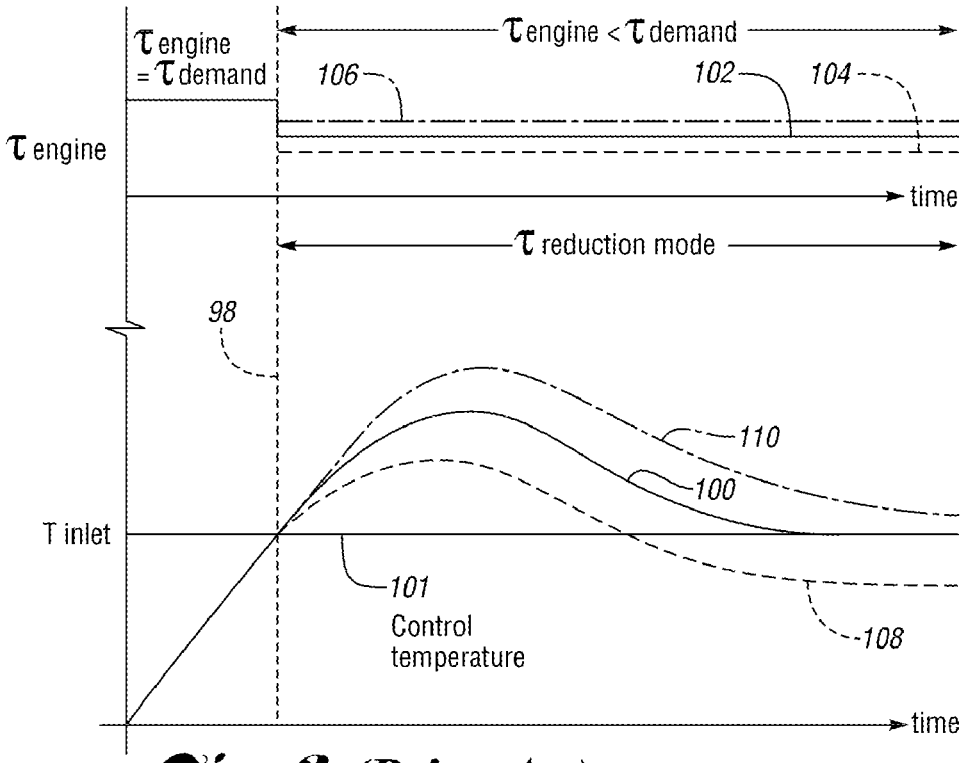
Fig. 3 (Prior Art)
FIG. 3 is a timeline of engine torque and turbine inlet temperature according to an open-loop control strategy.

In FIG. 3, a time line of a control strategy is shown for an example situation in which a vehicle is climbing a long, steep grade pulling a load. This is representative of an operating condition in which a high torque is demanded from the engine for a sustained period, possibly also at high ambient temperature. FIG. 2 illustrates a situation in which the vehicle operator is demanding a constant torque to ascend the grade. During the early stages of the hill climb, left of 98 in FIG. 3, torque provided by the engine equals operator-demanded torque. However, because the demanded torque is high to allow the vehicle to ascend the hill, engine operating temperatures rise rapidly. One such temperature, turbine inlet temperature 100, T, rises rapidly during the initial stages of the high torque demand (bottom graph of FIG. 3). At the time denoted by vertical dashed line 98, turbine inlet temperature 100 equals a control temperature 101. At this point, the control scheme enters a torque reduction mode in which torque is dropped by a particular amount. The strategy illustrated in FIG. 3 is an open loop strategy in which torque is reduced by a predetermined amount when the control temperature is breached. The resulting torque 102 provided by the engine is less than the operator demanded torque to protect the turbine from damage. The operator of the vehicle senses the sudden drop in torque. Due to thermal inertia in the system, the sudden decrease in engine torque 102 fails to immediately impact turbine inlet temperature 100 such that turbine inlet temperature 100 substantially overshoots control temperature 101 before reducing.

In the example discussed in relation to engine torque 102, turbine inlet temperature 100 ultimately settles in at the control temperature 101 at steady state. However, turbine inlet temperature 100, overshoots the control temperature 101 before attaining such temperature in the steady state. In one scenario, control temperature 101 is a maximum hardware temperature; turbine inlet temperature 100 does eventually reach control temperature 101. However, there is considerable temperature overshoot, which may cause damage to the turbine. In another scenario, control temperature 101 is less than the hardware limit temperature and the resulting torque is lower than need be to attain hardware limit temperature at steady state.

To minimize the temperature excursion, an even greater torque drop 104 may be employed. The resulting turbine inlet temperature 108 still overshoots control temperature 101, but by less of a margin and for a shorter duration than the turbine inlet temperature 100 trace. With torque reduction 104, the resulting turbine inlet temperature 108 is even lower than with torque reduction 102.

Finally, if a torque reduction 106 is less than necessary, i.e., the predetermined torque reduction according to the control strategy is insufficient for the particular operating condition encountered, the resulting temperature 110 exceeds control temperature 101 by a greater margin and continues to exceed control temperature 101 in the steady state. Such a situation is likely to result in damage to the turbine.

To ensure that control temperature 101 is not excessively breached, control according to the strategy discussed in regard to FIG. 2 tends to overcompensate on the torque drop, at least for an average condition, to minimize the likelihood of exceeding control temperature 101 at most, if not all, conditions. The problems with such a strategy are that because no torque compensating measure is taken until control temperature 101 is reached, the turbine inlet temperature (100, 108, and 110, depending on magnitude of torque reduction) always overshoots the control temperature 101. Also, the torque drop is abrupt and very noticeable to the operator of the vehicle, leading to customer dissatisfaction. Because the torque drop is a predetermined amount, it is more than necessary for many operating conditions, thereby an additional source of customer dissatisfaction.

Figure 4:
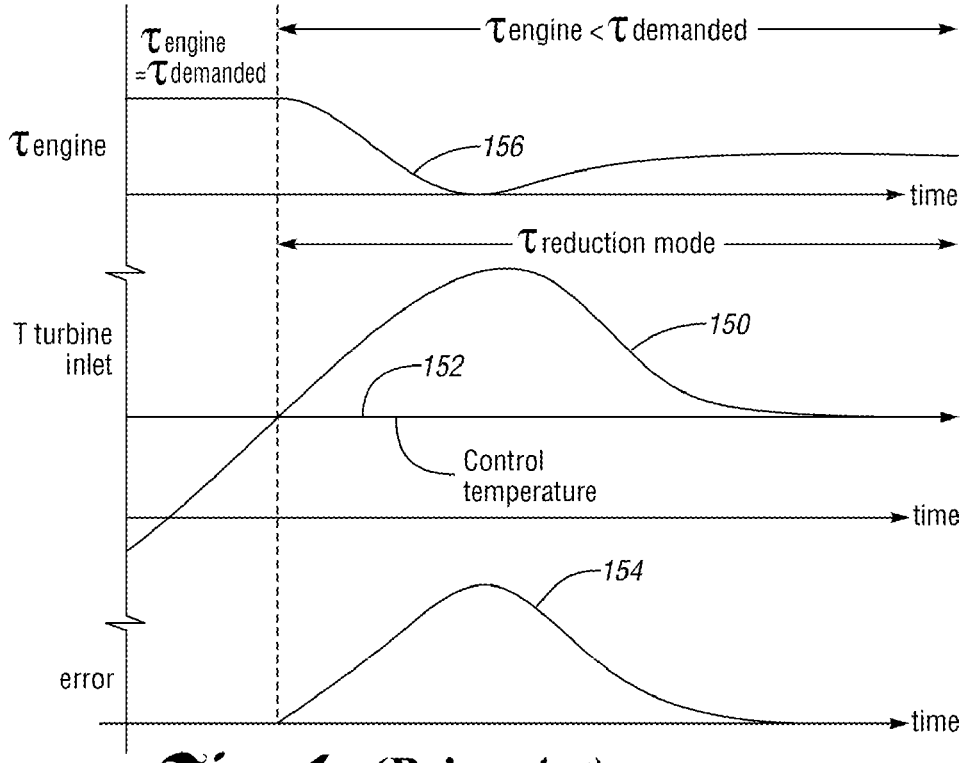
Fig. 4 (Prior Art)
FIG. 4 is a timeline of engine torque, turbine inlet temperature, and error according to a closed-loop control strategy.

In FIG. 4, another control strategy is shown in which torque reduction is initiated when turbine inlet temperature 150 exceeds a control temperature 152 and the amount of torque reduction is based on a difference in the two temperatures, error 154, shown at the bottom of FIG. 3. Under such a control strategy, the resulting torque reduction is a smooth reduction. However, because is it is based on error 154 in the temperature, the torque reduction is modest, until turbine inlet temperature 150 exceeds control temperature 152 by a substantial margin. Therefore, the resulting turbine inlet temperature 150 overshoots control temperature 152 by a substantial margin. When control temperature 152 is set at a much lower temperature than the hardware limit temperature to ensure that the overshoot in temperature is such that it would not damage the turbine, then the steady state temperature (achieved at the right hand side of FIG. 3), is well below the hardware limit temperature. Thus, the amount that the torque is reduced to maintain this lower than necessary temperature is greater than needed. In a scenario where control temperature 152 is set at the hardware limit temperature, the amount of overshoot in such a control strategy is excessive and likely leads to damage or failure of the turbine. The strategy illustrated in FIG. 4 results in quite a bit higher temperature overshoot than the strategy illustrated in FIG. 3 because the strategy of FIG. 4 only starts off with a modest torque reduction upon breaching the control temperature as opposed to an immediate torque drop with the strategy of FIG. 3. However, the strategy of FIG. 4 provides a smoother torque reduction than the strategy of FIG. 3, which is less noticeable to the operator of the vehicle.

Figure 5:
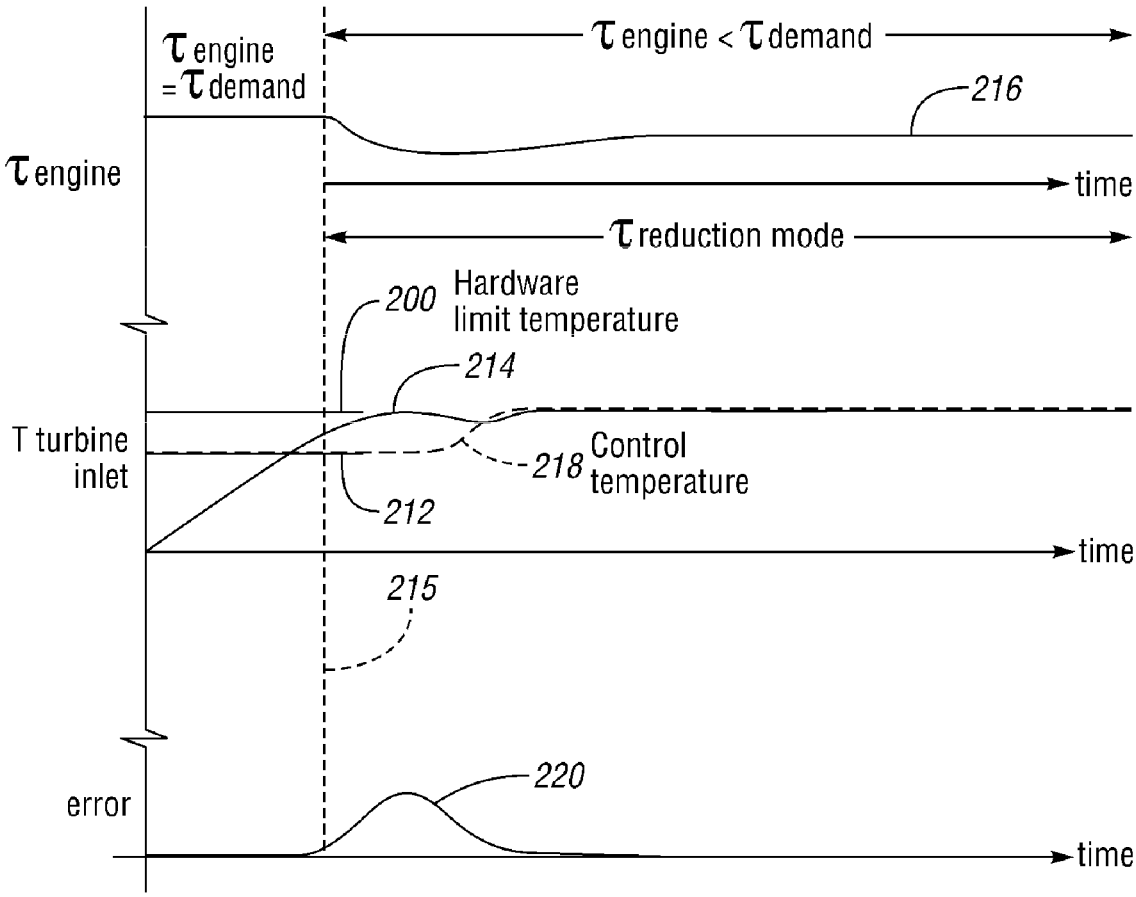
FIG. 5 is a timeline of engine torque, turbine inlet temperature, and error according to an embodiment of a control strategy of the present disclosure.

In FIG. 5, an embodiment according to the present disclosure is illustrated. Referring first to the middle graph, two temperature thresholds are applied: hardware limit temperature 200 and a control initiation temperature 212. According to an embodiment of the present disclosure, control is initiated before turbine inlet temperature 214 attains, or exceeds, hardware limit temperature 200. Instead, control is initiated when turbine inlet temperature 214 rises to control initiation limit temperature 212, which is less than hardware limit temperature 200. Torque control is applied earlier in the temperature rise than under the control schemes described in relation to FIGS. 3 and 4. Torque reduction mode begins at the time denoted by 215 in FIG. 4. Maximum hardware temperature may be in the range of about 800 degrees C. Control initiation temperature is less than the maximum hardware temperature by 20 to 80 degrees C.

Engine torque 216 reduces after 215 and the torque reduction is based upon a difference between a setpoint temperature 218 and turbine inlet temperature 214, shown as error 220 in the bottom portion of FIG. 5. Error 220 equals turbine inlet temperature 214 minus setpoint temperature 218. Setpoint temperature 218 is set equal to control initiation temperature 212 prior to entering the torque reduction mode and early in the torque reduction mode. In one embodiment, until turbine inlet temperature 214 is within a threshold of setpoint temperature 218, setpoint temperature 218 is not allowed to rise.

Referring to the error graph at the bottom of FIG. 5, as turbine inlet temperature 214 exceeds setpoint temperature 218, error 220 rises, as shown to the right of line 215. Because torque 216 is computed based on error 220, torque 216 reduces smoothly. This is in contrast with FIG. 3 in which torque drops abruptly once turbine inlet temperature 100 exceeds control temperature 101.

Referring again to FIG. 5, when error 220 reduces from the peak, turbine inlet temperature 214 is under control. Setpoint temperature 218 is allowed to increase over a period of time until it equals hardware limit temperature 200. Torque 216 smoothly attains its steady state value under such control. According to an embodiment of the present disclosure, by initiating torque control at control initiation temperature 212, turbine inlet temperature 214 does not exceed hardware limit temperature 200. Also, because setpoint temperature 218 rises after control over turbine inlet temperature 214 has been established, turbine inlet temperature 218 rises to hardware limit temperature 200 in a controlled fashion. This presents a distinct advantage over the strategy described in relation to FIG. 4. In the strategy illustrated in FIG. 4, if control temperature 152 is set to the hardware limit temperature, then turbine inlet temperature 150 far exceeds the hardware limit temperature, for a period of time, and likely damages the turbine. If, however, control temperature 152 is set to a lesser temperature than the hardware limit temperature, then turbine inlet temperature 150 is less than it needs to be, in the steady state and consequently torque 156 is reduced by more than necessary. Thus, either turbine inlet temperature 150 is allowed to be too high or the torque reduced is more than necessary. However, no such compromise is encountered by the strategy described in regards to FIG. 5.

Torque control is based on the error in temperature, i.e., temperature difference between setpoint temperature 218 and turbine inlet temperature 214. Control can be a simple proportional control, proportional-integral (PI) control, or proportional-integral-derivative (PID) control, according to principles well-established in the art.

Figure 6:
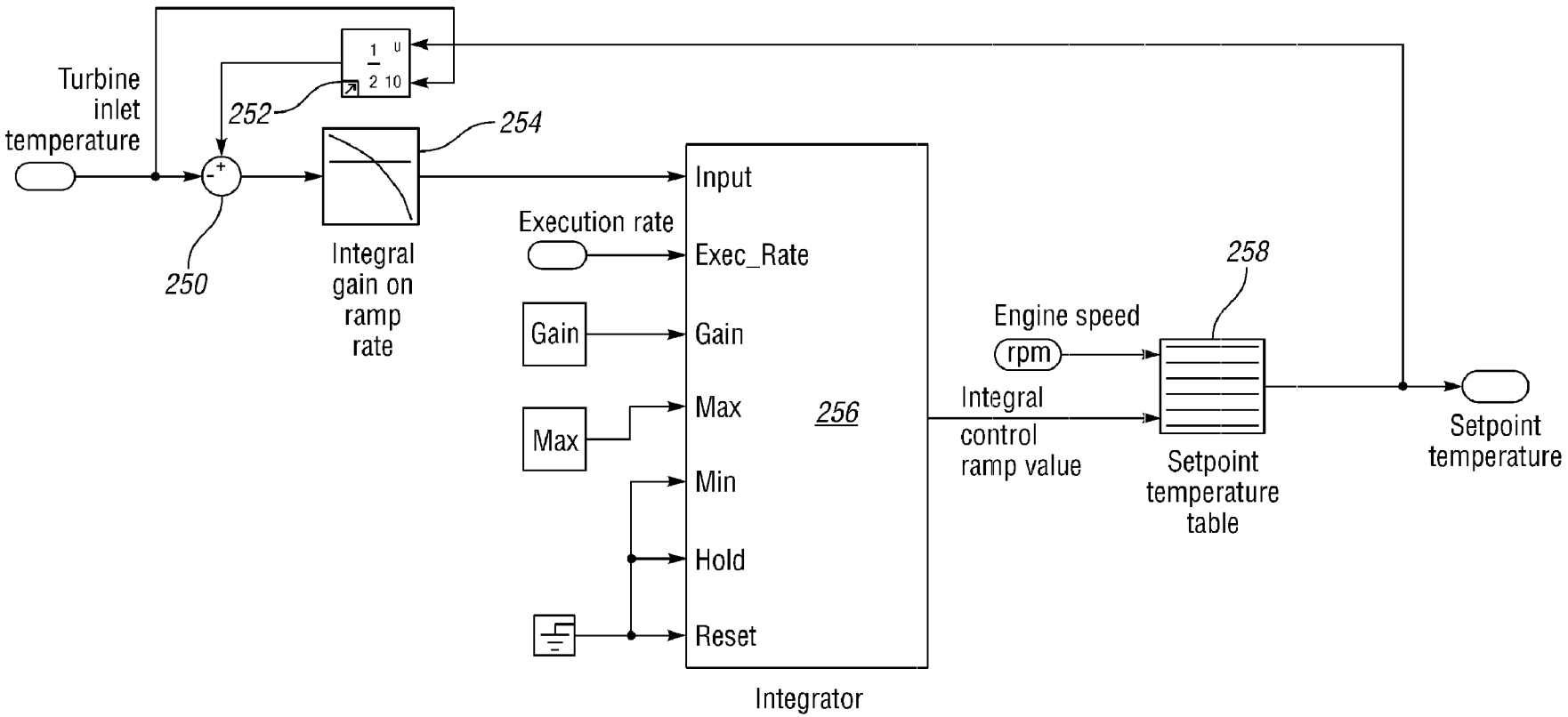
FIG. 6 is a control diagram for determining setpoint temperature according to an embodiment of the present disclosure.

In FIG. 6, a setpoint temperature 218 control strategy, according to an embodiment of the disclosure, is shown schematically. Operation 250 is a comparator with inputs of turbine inlet temperature and setpoint temperature and an output of error. Time delay 252 is applied to the setpoint temperature input to ensure that the results of the last control adjustment have propagated through the system prior to making additional adjustments. Error is an input to block 254; based on the magnitude of the error, an integral gain ramp rate is determined. The integral gain ramp rate is an input to integrator 256. Other inputs include the execution rate, i.e., whether the routine executes with faster loop or slower loop operations, gain, etc. Output from integrator 256 is the integral control, which is related to an amount that the setpoint temperature can be adjusted. A lookup table 258 has input from the integrator and also engine speed to determine the output, the new setpoint temperature.

In the above discussion, torque is the engine parameter that is adjusted to control turbine inlet temperature. However, there are other measures that can be taken to reduce turbine inlet temperature. For example, the near and far post injections, illustrated in FIG. 2, are provided as a way to increase exhaust temperature to support DPF regeneration, as well as other operating conditions. In one alternative, both torque and the post injections are adjusted to control engine temperature. In particular, the far post injection and/or the near post injections can be eliminated altogether. Or, the timing of the post injections can be adjusted. In another alternative, control of the post injections can be used in place of controlling engine torque.

Another factor to consider in controlling post injections is that unburned, or partially oxidized, fuel that is supplied to the engine exhaust oxidizes only minimally until the fuel encounters DOC 60, which is downstream of turbine 30*b*, as shown in FIG. 1. Oxidation of the unburned fuel within DOC 60 causes the temperature in DOC 60 to rise rapidly. Fuel in the far post injection oxidizes little in the combustion chamber, while much of the fuel injected during a near post injection oxidizes, at least partially, and contributes some to engine torque. Since turbine 30*b* is not affected by oxidation occurring downstream, careful balancing of the near and far post injections can yield a temperature at the turbine inlet below the hardware limit temperature, but still have a sufficient increase in DOC 60 to regenerate DPF 64.

EGR rate also impacts exhaust temperature. As with post injections, EGR rate can be used as the engine parameter that is used to control turbine inlet temperature. Alternatively EGR rate, along with engine torque or other engine parameters, can be used to control turbine inlet temperature.

Any engine parameter which affects turbine inlet temperature can be used singly, or in combination with one or more other engine parameters, to control turbine inlet temperature. Other parameters may include transmission parameters (lockup torque converter and gear selection), engine speed (affected by gear selection), injection timings, fuel quantity supplied (related to torque), accessory loads (air conditioning, battery charging, as examples), and throttle valve 28 position. The resulting control is like that shown in FIG. 5, except that instead of torque, the engine parameter(s) are plotted. Also, instead of torque control mode, it is called a temperature control mode.

It is desirable to provide the operator with close to the amount of torque that is being demanded, without, of course, causing damage to engine components, such as the turbine. Thus, in one embodiment, other engine parameters are adjusted, preferentially, to reduce turbine inlet temperature. However, if there is sufficient authority to control temperature by the other engine parameters of if there are competing demands, such as completing regeneration of the DPF 64, then torque is employed secondarily to ensure that the turbine inlet temperature does not exceed its maximum hardware temperature.

While the best mode has been described in detail, those familiar with the art will recognize various alternative designs and embodiments within the scope of the following claims.

For example, a control method is described for gradually increasing setpoint temperature. However, other methods to cause setpoint temperature to gradually increase from the control initiation temperature to the maximum hardware temperature are also within the scope of the present disclosure. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed:

1. A method to control an internal combustion engine having an exhaust turbine, comprising:

determining a turbine inlet temperature;

entering a torque reduction mode when the turbine inlet temperature exceeds a setpoint temperature;

commanding the internal combustion engine to provide a torque less than an operator demanded torque based on an error, the error based on the turbine inlet temperature minus the setpoint temperature; and increasing the setpoint temperature gradually to a maximum hardware temperature during the torque reduction mode.

2. The method of claim 1 wherein the setpoint temperature is equal to a control initiation temperature when the torque reduction mode is entered and the control initiation temperature is less than the maximum hardware temperature.

3. The method of claim 2 wherein the control initiation temperature is less than the maximum hardware temperature by 20 to 80 degrees C.

4. The method of claim 1 wherein the torque provided is controlled by a proportional-integral control loop based on error.

5. The method of claim 1 wherein the maximum hardware temperature is a maximum turbine inlet temperature that can be supplied to the exhaust turbine.

6. A method to control an internal combustion engine having an exhaust turbine, comprising:

determining a turbine inlet temperature;

entering a temperature reduction mode when the turbine inlet temperature exceeds a setpoint temperature;

adjusting an engine parameter to cause the turbine inlet temperature to decrease; and increasing the setpoint temperature gradually to a maximum hardware temperature during the temperature reduction mode.

7. The method of claim 6 wherein the adjusting of the engine parameter is based on an error, the error being a difference between the turbine inlet temperature and the setpoint temperature.

8. The method of claim 7 wherein the engine parameter is adjusted according to a proportional-integral control loop based on the error.

9. The method of claim 6 wherein the internal combustion engine has an EGR system including: an EGR duct coupled between an engine intake and an engine exhaust and an EGR valve disposed in the EGR duct, and the engine parameter is an EGR rate which is adjusted by changing a position of the EGR valve.

10. The method of claim 9 wherein the internal combustion engine has a plurality of cylinders with a fuel injector coupled to each cylinder, the engine parameter is a post injection event which is adjusting by changing a duration of the post injection event.

11. The method of claim 10 wherein the post injection event is a near post injection event which is initiated in the range of 20 to 40 degrees after top center during the expansion stroke.

12. The method of claim 10 wherein the post injection event is a far post injection event which is initiated after 90 degrees after top center during the expansion stroke.

13. The method of claim 7 wherein the engine parameter is torque.

14. An internal combustion engine, comprising:

an exhaust turbine coupled to an engine exhaust;

engine cylinders having a fuel injector coupled to each of the engine cylinders;

a throttle valve disposed in an engine intake;

an EGR system with an EGR duct coupling the engine intake with the engine exhaust and an EGR valve disposed in the EGR duct;

an electronic control unit electronically coupled to the fuel injectors and the EGR valve, the electronic control unit: determining a turbine inlet temperature; entering a temperature reduction mode when the turbine inlet temperature is greater than a setpoint temperature; adjusting at least one of a pulse width to the fuel injectors, an injection timing to the fuel injectors; a position of the EGR valve, and a position to the throttle valve to cause the turbine inlet temperature to decrease in response to entering the temperature reduction mode; and increasing the setpoint temperature after entering the temperature reduction mode.

15. The engine of claim 14 wherein the fuel injector is commanded multiple injections in a single engine cycle including: a main injection, a near post injection, and a far post injection and the at least one pulse width adjustment is to the main injection.

16. The engine of claim 15 wherein pulse width of the near post injection is also adjusted.

17. The engine of claim 15 wherein pulse width of the far post injection is also adjusted.

18. The method of claim 14 wherein the turbine inlet temperature is determined by an engine model with engine speed, fuel injection timings, fuel injection pulse widths, EGR rate, and throttle valve position being inputs to the engine model.

19. The method of claim 14 wherein the increasing of the setpoint temperature is performed gradually.

20. The method of claim 14 wherein the increasing of the setpoint temperature is delayed until after the turbine inlet temperature is under control and gradually increased thereafter.

* * * * *